United States Patent [19]

Zimmer

[11] Patent Number: 4,989,509

[45] Date of Patent: Feb. 5, 1991

[54] MOUNTING ARRANGEMENT FOR APPLICATOR ROLLER

[76] Inventor: Johannes Zimmer, Ebentaler Strasse 133, A-9020 Klagenfurt, Austria

[21] Appl. No.: 328,251

[22] PCT Filed: Jun. 3, 1988

[86] PCT No.: PCT/AT88/00043

§ 371 Date: Feb. 2, 1989

§ 102(e) Date: Feb. 2, 1989

[87] PCT Pub. No.: WO88/09726

PCT Pub. Date: Dec. 15, 1988

[30] Foreign Application Priority Data

Jun. 3, 1987 [DE] Fed. Rep. of Germany ..... 8708044
Oct. 10, 1987 [DE] Fed. Rep. of Germany ..... 8713787

[51] Int. Cl.[5] ..... B41F 15/44
[52] U.S. Cl. ..... 101/120; 118/262
[58] Field of Search ..... 101/120, 119; 118/213, 118/258, 262; 384/418, 419

[56] References Cited

U.S. PATENT DOCUMENTS

| | | | |
|---|---|---|---|
| 628,651 | 7/1899 | Cummings | 101/120 |
| 3,965,816 | 6/1976 | Mitter | 101/120 X |
| 3,988,986 | 11/1976 | Zimmer | 101/120 X |
| 4,216,716 | 8/1980 | Zimmer | 101/120 |
| 4,417,515 | 11/1983 | Mitter | 101/120 |
| 4,453,462 | 6/1984 | Mitter | 101/120 X |

FOREIGN PATENT DOCUMENTS

| | | | |
|---|---|---|---|
| 2305443 | 8/1974 | Fed. Rep. of Germany | 101/120 |

*Primary Examiner*—Clifford D. Crowder
*Attorney, Agent, or Firm*—Wenderoth, Lind & Ponack

[57] ABSTRACT

In a device for applying fluid substances in printing and coating machines, carrying plates are fixed to ends of a carrying beam. The carrying plates have recesses therein in which pivot axles of a coating roller are loosely and rotatably mounted. Stopping surfaces are provided to limit lateral movement of the coating roller by abutting with its pivot axles. The stopping surfaces are formed adjacent the recesses formed in the carrying plates and converge in the direction in which a fabric strip which is to be printed on is moved beneath the roller.

11 Claims, 3 Drawing Sheets

MOUNTING ARRANGEMENT FOR APPLICATOR ROLLER

BACKGROUND OF THE INVENTION

The invention concerns a device for the application of fluid substances in printing and coating machines, and more particularly to such a device which includes carrying plates which are attached to a carrying beam and which include recesses therein within which pivot axles of a magnetic application roller are loosely rotatably disposed.

In known devices of this type, an application roller (or ductor roller) is caused to press against a fabric strip, which is to be imprinted, by a magnetic beam arranged below the fabric strip. The carrying plates of such a roller should prevent unintentional deviation of the roller from its desired direction and allow for removal of the roller from the carrying plates.

An important advantage obtained by magnetically causing a ductor roller to press against the fabric strip is that essentially no forces are introduced at the ends of the roller so that no deflection of the roller occurs. In order to assure this advantage, the carrying plates provided are not designed as bearings which fix the position of the pivot axles, but as a type of cage which limits the amount which the roller can deviate from its normal position in the horizontal plane and which allows the roller to be removed from the carrying plates. Because the roller, in this arrangement, is allowed to move somewhat in the horizontal plane, the roller may become slanted relative to its normal position transverse of the running direction of the fabric strip. Such slanting of the roller may cause operational problems. For example, slanting of the roller while it is rotating will cause it to shift in the axial direction and thus cause its pivot axles to bear against stopping surfaces provided on either side of the rollers to limit the crosswise movement of the roller. This leads to wear of both the stopping surfaces and the pivot axles.

In addition, in some prior art fluid substance applying machines such as those described above, and in particular in rotary screen printing machines, the carrying beam is used for supplying the fluid substance to the working area. Because the carrying beam usually has a relatively large diameter, upon changing color or performing maintenance work on the device, there is a considerable loss of the fluid substance.

SUMMARY OF THE INVENTION

Among the objects of the present invention are to avoid the described disadvantages of the prior art devices, and to provide for ease, safety and economy of operation of a device for applying fluid substance.

According to the invention, the objects are fulfilled by providing an apparatus for the application of fluid substances in printing and coating machines, comprising: a carrying beam having first and second ends; first and second carrying plates attached respectively to said first and second ends of said carrying beam and having first and second recesses formed therein; a rotatable application roller; mounting means, comprising first and second pivot axles extending through said first and second recesses, respectively, for mounting said roller to said first and second carrying plates for rotation with respect to said first and second carrying plates; and first and second stopping means for abutting with an end of each of said first and second pivot axles, respectively, to allow some axial movement of said roller but limit the axial movement of said roller in each respective axial direction thereof. In addition each of said first and second stopping means includes a stopping surface which is disposed at an oblique angle relative to the common pivot axis of the first and second pivot axles. These angled stopping surfaces provide simple means to cause the roller, when in a slanted position, to return to its regular position transverse to the direction in which the fabric strip is moved. This occurs because, when the roller is slanted, it will shift axially, bear against one of the angled stopping surfaces and be returned to its transverse position due to the angular orientation of the stopping surface.

The carrying plates can be made of steel as it is rare that they come into contact with the application roller during operation. Closing plates may be provided to cover the recesses in the carrying plates and are preferably formed as plastic bodies, which have the stopping surfaces formed therein and are screwed to the carrying plates.

Printing substance restraining plates are conventionally used to prevent the printing substance from extending laterally beyond limits. Conventionally, the restraining plates have been provided on the carrying plates, but, due to the arrangement of the pivot axles of the present invention, the restraining plates can be mounted about the pivot axles and the roller and positioned between the respective carrying plates.

At least one slit is preferably provided in each of the restraining plates to act as means for mounting a printing substance retaining board forwardly of the roller so as to limit the amount of substance located in front of the roller.

As mentioned previously, the carrying beam for the roller is conventionally also used as a printing substance supply tube. The carrying beam, however, is often of such a large diameter that considerable printing substance is lost upon changing colors. This disadvantage is reduced by the present invention by providing an additional tube arranged in the carrying beam which is used as the substance supply tube. Preferably, the substance supply tube is arranged in the carrying beam such that outlets thereof open into discharge openings formed in the carrying beam. Also, the supply tube is preferably welded, glued or clamped within the carrying beam.

An alternative construction can be used for reducing wear of the pivot axles and stopping surfaces due to axial shifting of the roller. That is, the pivot axles can be fixed to the carrying plates and the angled stopping surfaces can be formed in the ends of the application roller.

In a device, designed in general for the application of fluid substances onto strips or pieces of material, the fluid substance is fed by a substance supply line, preferably a substance supply tube mounted in the carrying beam and having at least one substance discharge opening which opens into a discharge opening of the carrying beam. In this manner the carrying beam itself with its large diameter is no longer acting as the substance supply line. Rather, substance is supplied by the substance supply tube which is considerably smaller in diameter than the carrying beam and is mounted in the carrying beam. In this manner the fluid substance losses, which occur when the machine is inoperative due to technical difficulties or substance change, are reduced considerably to an amount which is more tolerable.

This reduced loss of substance can be economically significant.

The substance supply tube can be simply and economically mounted such that discharge openings therein are arranged adjacent the discharge opening of the carrying beam. The supply tube should be connected to the carrying beam such that the two are properly sealed. This can be accomplished by means of welding, gluing or the like. It is important that, while the interior space of the carrying beam serves as a holding space for the substance supply tube, the substance does not seep out of the supply tube and damage the carrying beam.

In order to provide for ease of assembly and disassembly of the supply tube from the carrying beam, e.g. to change the substance or to provide for maintenance or repair, the substance supply tube can be clamped within the carrying beam in a tight-fitting manner. To this end, clamping devices are arranged in the carrying beam and are adapted to bear against the outer surface of the substance supply tube. These clamping means can consist of protrusions, such as bridges, arms or clamps, extending inwardly from the interior surface of the carrying beam so as to hold the substance supply tube centrally in its working position.

The carrying beam can be constructed with various profiles and is preferably made of aluminum. Different profiles can provide different advantages with regard to production, weight, and resistance to corrosion from the various substances transported in the supply tube. Selection of materials for the beam and tube must take into account the various connections that must be made.

The use of a clamping means for mounting the substance supply tube within the carrying beam makes the supply tube readily mountable and dismountable and provides an economical arrangement.

BRIEF DESCRIPTION OF THE DRAWINGS

Further advantages of the invention will be apparent from the following description of the invention when read in conjunction with the drawing figures, in which.

DETAILED DESCRIPTION OF THE INVENTION

Figure 1:
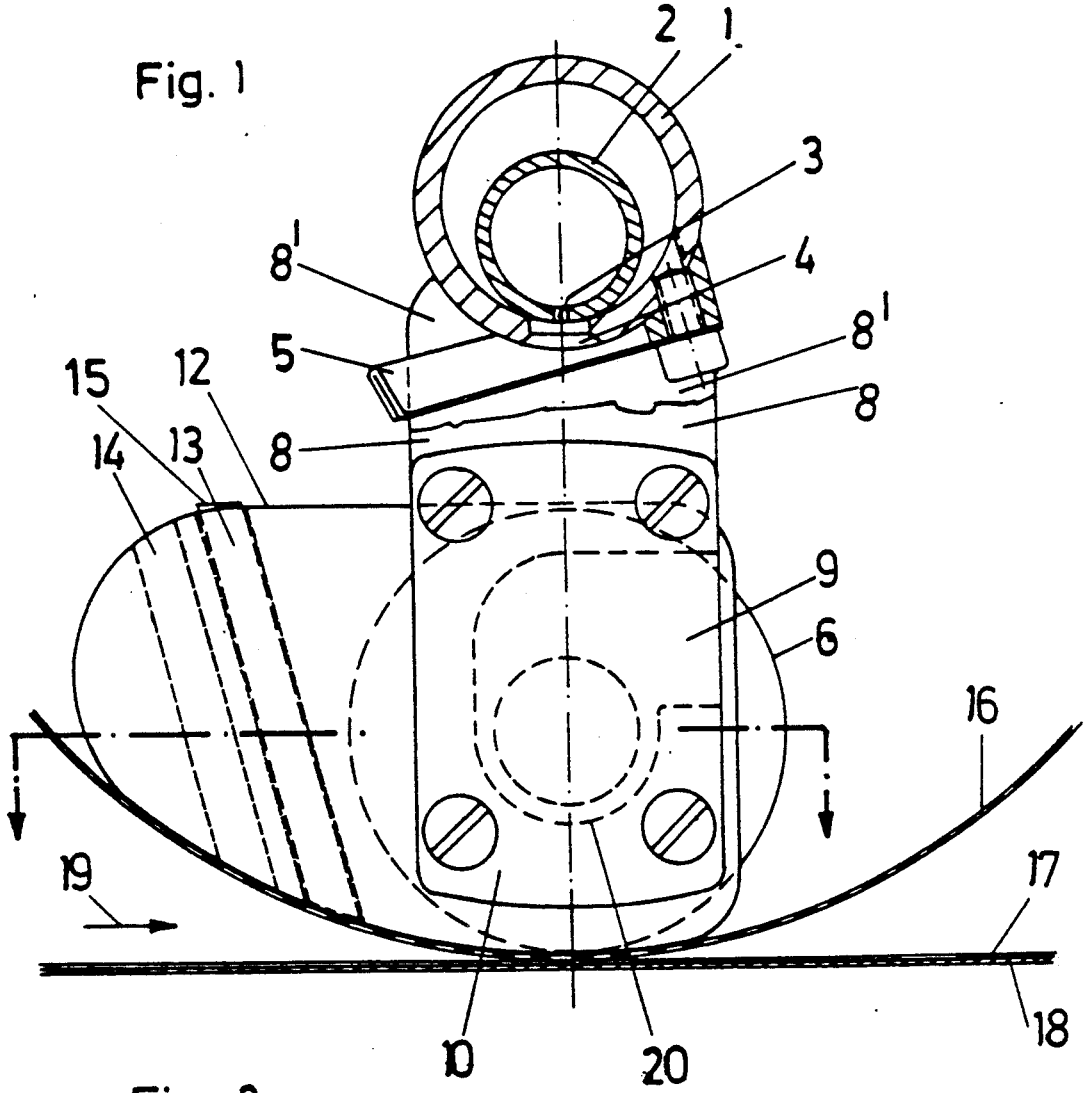
FIG. 1 is a partially cut away elevation view of a first embodiment of the invention.

FIG. 1 shows the essential elements of a screen printing machine according to the first embodiment of the present invention. An application roller 6 is arranged on the inside of a rotating screen 16. The roller 6 is caused to press against the inside of the rotating screen 16 by a magnet (not shown) arranged beneath a printing cloth 18. With this arrangement, a printing substance placed in front of the application roller 6 is pressed into a the fabric strip 17 arranged between the cloth 18 and the screen 16.

The position of the application roller 6 is determined by the magnet arranged below the cloth 18, so that the roller 6 does not need to be mounted in a confined manner. Carrying plates 8 and 8′ are arranged on both sides of the application roller, are attached to either side of a carrying beam 1 and include recesses 9 formed therein. The roller 6 includes pivot axles 7 which are loosely received in recesses 9 of carrying plates 8 and 8′. Due to the loose mounting of the pivot axles 7 within recesses 9, the recesses 9 serve as mounting cages for the pivot axles 7 of the application roller 6 and are arranged such that the application roller 6 can be lifted away from the inside of the rotating screen 16. So that the pivot axles 7 can be inserted and removed from the carrying plates 8, 8′, the recesses 9 extend horizontally and open through edges of the carrying plates 8, 8′. The roller 6 is prevented from deviating too far from its desired direction of travel (for example, when no magnetic field is present below cloth 18) because the pivot axles 7 are loosely confined in downwardly extending portions 20 of the recesses 9.

In order to prevent the application roller 6 from becoming slanted relative to its normal in-use position perpendicular to its desired forward direction of travel, closing plates 10 are mounted to the carrying plates on surfaces thereof opposite the roller 6. Recessed stopping surfaces 11 are formed in the closing plates 10 and are adapted to abut with the pivot axles 7. The closing plates serve to cover the recesses 9 in the carrying plates 8, 8′. The stopping surfaces 11 are formed at oblique angles relative to a pivot axis common to the pivot axles 7 and function to return a slanted application roller to its proper position. This occurs because a slanted application roller will shift axially and come into abutment against one of the stopping surfaces 11. The angled surface 11 will then cause the application roller 6 to return to its proper lateral position with regard to the direction 19 in which the fabric strip 17 is moved beneath the roller 6.

In order to retain the printing substance located in front of the application roller 6 within lateral limits, substance restraining plates 12 are arranged on either side of the application roller 6 between the roller 6 and the respective carrying plates 8, 8′. Such an arrangement is much simpler than the customary arrangement in which such restraining plates are mounted on the carrying plates themselves.

Slits 13 and 14 are provided in the substance restraining plates 12 as a means for mounting, in one of two different positions, a printing substance restraining board 15, which limits the amount of substance located in front of the application roller 6.

The carrying beam 1 to which the carrying plates 8, 8′ are attached is a hollow tube-shaped carrying beam. In order to better regulate the amount of printing substance used, a printing substance supply tube 2 is mounted within the carrying beam 1 and has a diameter which is considerably smaller than the diameter of the carrying beam. The supply tube 2 includes discharge openings 3 and the carrying beam 1 includes openings 4 through which the printing substance is supplied onto a drip sheet 5 and from there onto an area in front of the application roller 6. The supply tube 2 and carrying beam 1 are preferably connected by welded seams which run along the edge of the openings 4.

Figure 2:
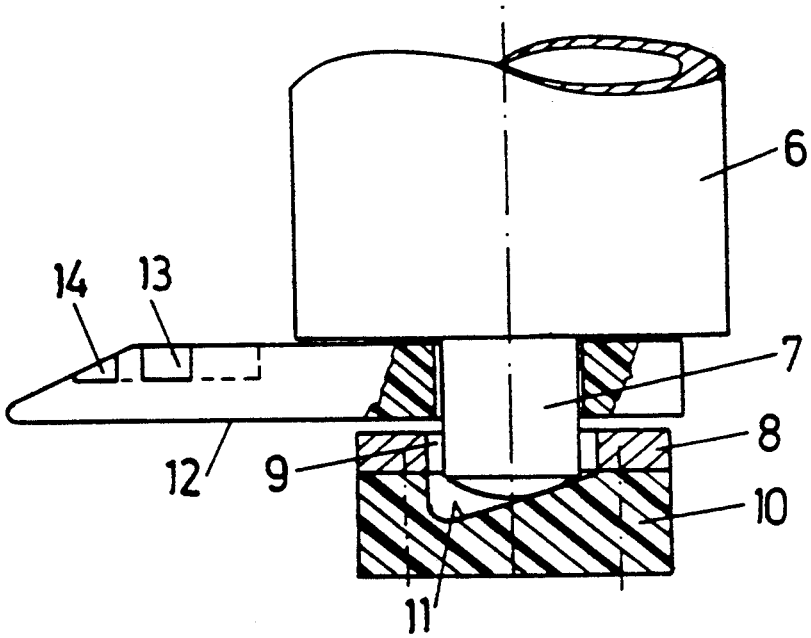
FIG. 2 is a partially sectional top view of the embodiment shown in FIG. 1.
Figure 3:
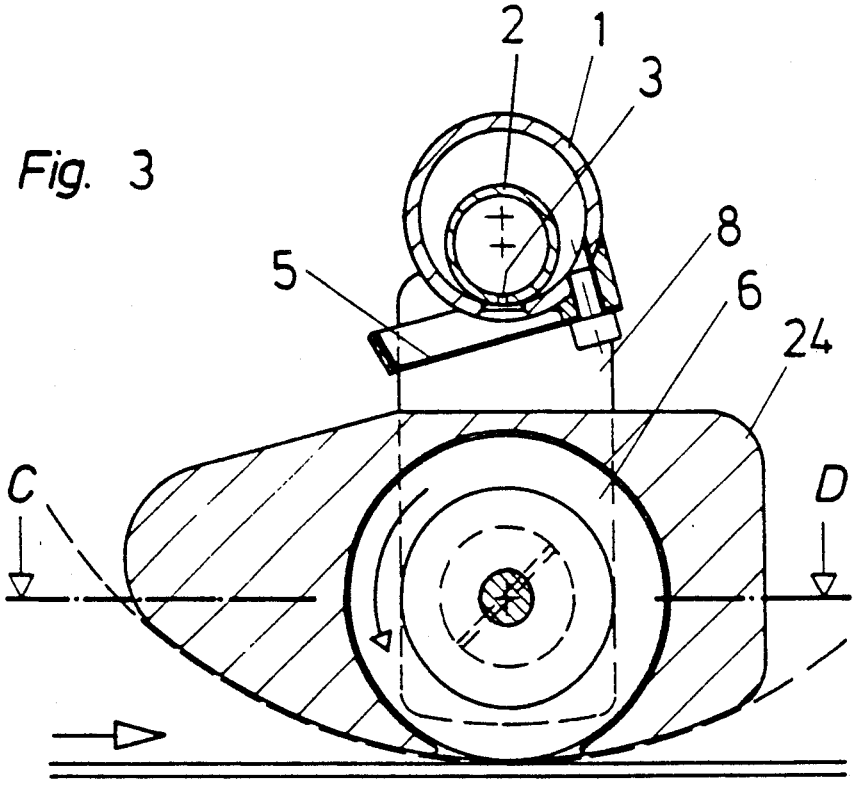
FIG. 3 is a partially cut away elevation view of a second embodiment of the invention.
Figure 4:
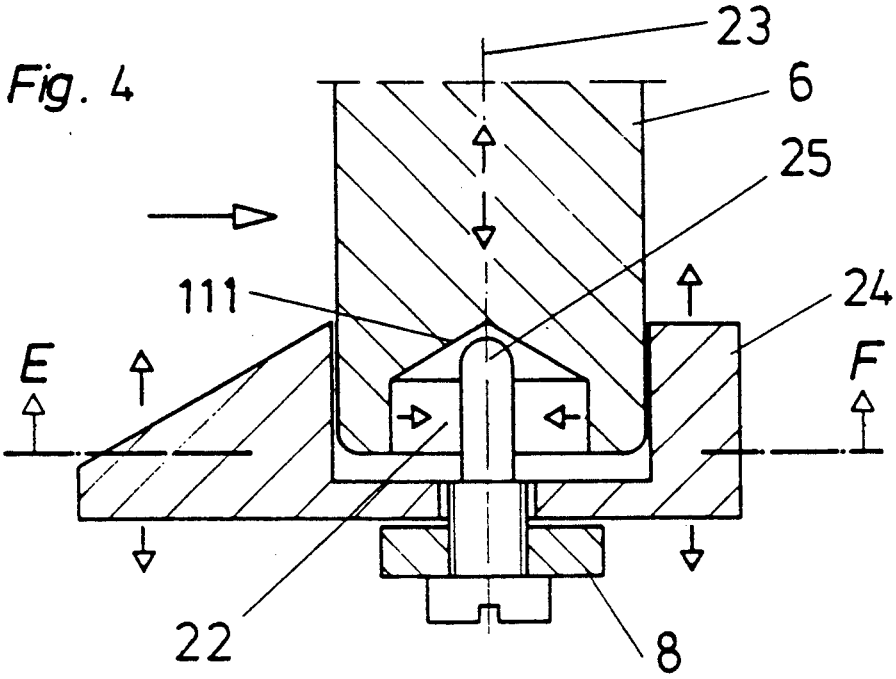
FIG. 4 is a partially sectional top view of the embodiment shown in FIG. 3.

The second embodiment of the invention is shown in FIGS. 3 and 4. It is substantially similar to the embodiment shown in FIGS. 1 and 2, but differs therefrom in the following manner. First, the roller 6 of the second embodiment has pivot axles 25 which are fixed to the carrying plates, extend inwardly therefrom, and are received in recesses 22 formed in ends of the roller 6. Also, rather than stopping surfaces being defined in a covering plate, in the second embodiment, stopping surfaces 111 are formed within the recesses 22 in the ends of the roller 6. These stopping surfaces are each formed with two surfaces which are angled relative to each other and relative to the common pivot axis 23 of the two pivot axles 25, and which meet along a line through the common pivot axis. Substance retraining plates 24 are provided to limit lateral flow of the printing substance and are formed so as to encircle the ends of the roller 6 but allow rotation thereof relative to the restraining plates 24. Sufficient spacing is provided between the restraining plates 24 and the roller 6 to allow sufficient movement of roller 6 along axis 23 relative to the pivot axles 25.

Figure 5:
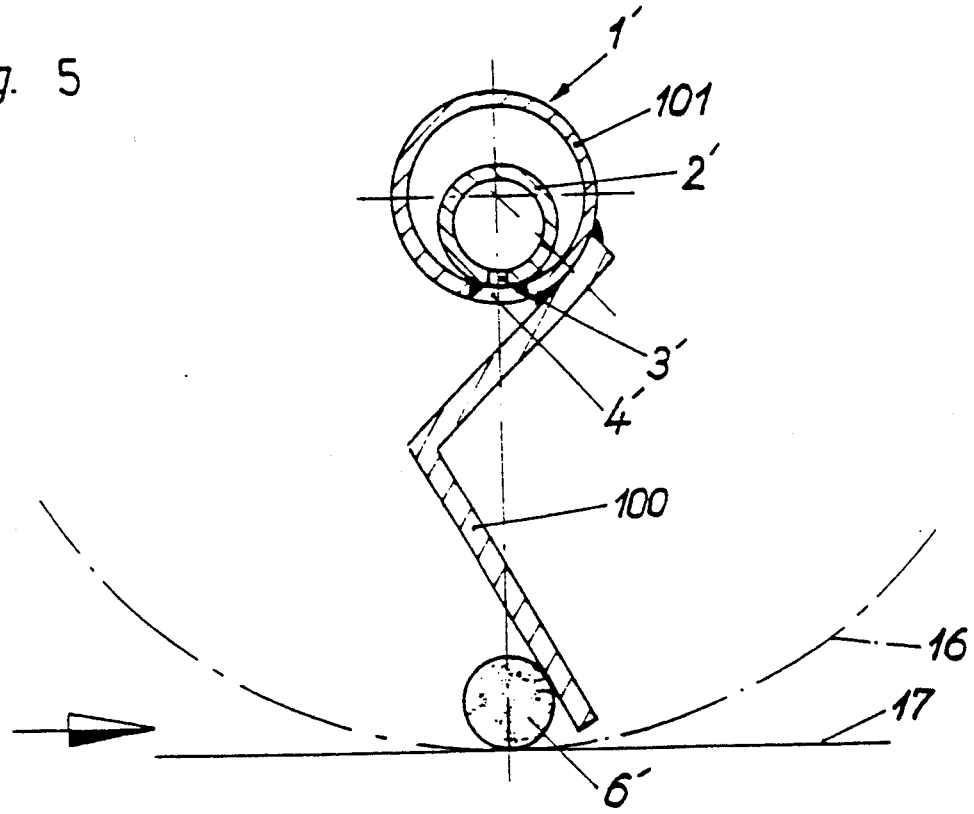
FIG. 5 is a sectional elevation view of a third embodiment of the invention.
Figure 6:
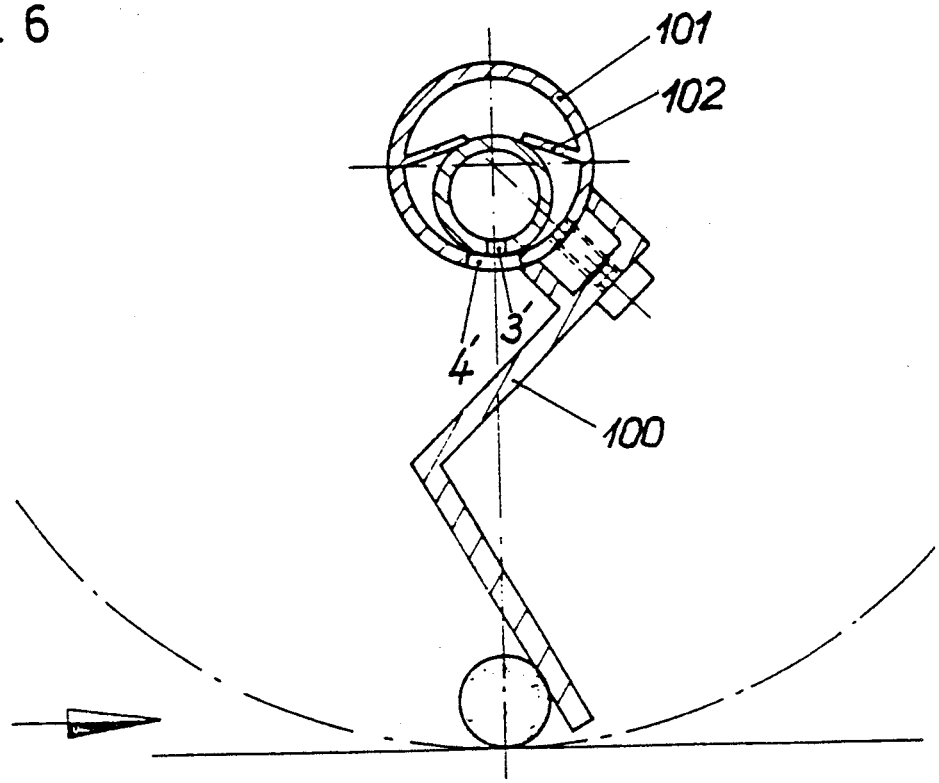
FIG. 6 is a sectional elevation view of a fourth embodiment of the invention.

An application device for fluid substances, shown in FIGS. 5 and 6, which can be generally used in machines for printing, coating, painting, dying, impregnating or similar procedures, is shown and described only with respect to its essential components. A holding element 100 is attached, e.g. by welding (FIG. 5) or by a screw connection (FIG. 6), to a hollow carrying beam 1'. This holding element 100 is provided to guide an application roller 6' which is provided to apply fluid substances of various viscosities, to a fabric strip or piece of material 17 which is moved in the direction of the arrow.

A substance supply tube 2 is mounted within the carrying beam 1', the carrying beam 1' being constructed here with a circular cross-section 101. The supply tube 2' has a considerably smaller diameter than the carrying beam 1' and is provided with substance discharge openings 3' which open into the discharge openings 4' in the carrying beam 1'. Carrying beam 1' and substance supply tube 2' extend across the width of the machine. The openings 3' and 4' are arranged in such a manner that the supply of substance, e.g. printing ink, through the substance supply tube 2' to the screen 16 is sufficiently controlled to provide proper application, e.g. printing. In order to prevent the substance from leaking into the inside of the carrying beam 1', the supply tube 2' is welded or glued to the inside wall of the carrying beam 1' along the area adjacent the discharge openings 3' and 4' (FIG. 5). Alternatively, the substance supply tube 2' can be tightly clamped within the carrying beam 1' as shown in FIG. 6. Such clamping is provided by bridges or holding straps 102, which are mounted in and can be integral with the carrying beam 1'. The bridges or holding straps 102 clamp the substance supply tube 2' to the carrying beam 1' such that the discharge openings 3' and 4' are aligned. These bridges or holding straps 102 make it possible to laterally insert or withdraw the substance supply tube 2' into or from the carrying beam 1'. In addition, this arrangement allows for the use of interchangeable substance supply tubes 2' which include discharge openings 3' at suitable intervals for varying discharge requirements. The carrying beam 1' can be coated on its inside wall in order to assure a tight fit of the substance supply tube.

The openings 3' and 4' can be formed with various shapes. Such as circular or elongated holes, continuous slits, etc., which are most suitable for various parameters, such as substance viscosity, amount to be supplied and degree of distribution necessary. A substance discharge opening may have a mouth piece or a neck-shaped discharge member attached thereto which extends through the discharge opening of the carrying beam.

The invention is equally suitable for applying substances with or without the use of a flat or a rotary screen such as screen 16.

I claim:

1. An apparatus for the application of fluid substances in printing and coating machines, comprising:

a carrying beam having first and second ends;

first and second carrying plates attached respectively to said first and second ends of said carrying beam and having first and second recesses formed therein;

a rotatable application roller;

mounting means, comprising first and second pivot axles having a common pivot axis and extending through said first and second recesses, respectively, for mounting said roller to said first and second carrying plates for rotation with respect to said first and second carrying plates; and first and second stopping means for abutting with an end of each of said first and second pivot axles, respectively, to allow some axial movement of said roller but limit the axial movement of said roller in each respective axial direction, each of said first and second stopping means comprising a closing plate mounted to a corresponding one of said first and second carrying plates, respectively, and having a recess formed therein, said recess defining a stopping surface disposed at an oblique angle relative to said common pivot axis.

2. An apparatus as recited in claim 1, wherein said first and second pivot axles are loosely rotatably mounted in said first and second recesses, respectively.

3. An apparatus as recited in claim 2, wherein said first and second pivot axles are attached to said roller and extend therefrom through said first and second recesses, respectively.

4. An apparatus as recited in claim 1, wherein said first and second pivot axles are attached to said roller and extend therefrom through said first and second recesses, respectively.

5. An apparatus as recited in claim 1, wherein said first and second carrying plates are formed of steel.

6. An apparatus as recited in claim 1, wherein said first and second pivot axles have a common pivot axis; and first and second substance restraining plates are mounted about said first and second pivot axles, respectively, and extend perpendicular to said common pivot axis.

7. An apparatus as recited in claim 6, wherein said first and second restraining plates are disposed between said first carrying plate and one end of said roller and said second carrying plate and the other end of said roller, respectively.

8. An apparatus as recited in claim 7, further comprising a restraining board; and means, on said first and second restraining plates, for mounting said restraining board generally parallel to said common pivot axis.

9. An apparatus as recited in claim 1, wherein said carrying beam is a hollow beam and has apertures formed therein communicating between an interior and an exterior of said carrying beam; and a supply means is mounted in said interior of said carrying beam and is operable to supply a printing substance through said aperture formed in said carrying beam.

10. An apparatus as recited in claim 9, wherein said supply means comprises a supply tube having a printing substance disposed therein.

11. An apparatus as recited in claim 10, wherein said supply tube is welded to said hollow carrying beam adjacent said apertures formed therein.

* * * * *